US005743447A

United States Patent [19]

McDermott

[11] Patent Number: 5,743,447

[45] Date of Patent: Apr. 28, 1998

[54] PORTABLE VARIABLE CAPACITY BACKPACK

[76] Inventor: Virginia B. McDermott, 216 Williamsburg Rd., Ardmore, Pa. 19003

[21] Appl. No.: 728,360

[22] Filed: Oct. 9, 1996

Related U.S. Application Data

[60] Provisional application No. 60/014,443, Apr. 1, 1996.

[51] Int. Cl.[6] ..... A45F 3/04

[52] U.S. Cl. ..... 224/153; 224/579; 224/583; 224/627; 224/657

[58] Field of Search ..... 224/153, 578, 224/579, 583, 627, 645, 652, 654, 657; 190/18 A, 103, 110

[56] References Cited

U.S. PATENT DOCUMENTS

| | | | |
|---|---|---|---|
| 3,917,038 | 11/1975 | Føge et al. . | |
| 4,087,102 | 5/1978 | Sprague . | |
| 4,254,850 | 3/1981 | Knowles . | |
| 4,361,215 | 11/1982 | Sawai | 190/103 |
| 4,418,804 | 12/1983 | Bradley et al. | 190/18 A |
| 4,588,055 | 5/1986 | Chen . | |
| 4,733,759 | 3/1988 | Shih-Chen | 190/103 |
| 4,756,394 | 7/1988 | Cohen . | |
| 5,083,645 | 1/1992 | Lee | 190/18 A |
| 5,109,961 | 5/1992 | Bergman . | |
| 5,114,164 | 5/1992 | Bothwell et al. . | |
| 5,209,328 | 5/1993 | Kotkins, Jr. | 190/103 |
| 5,240,106 | 8/1993 | Plath | 190/18 A |
| 5,303,805 | 4/1994 | Hauser . | |
| 5,307,908 | 5/1994 | Shyr et al. | 190/103 |
| 5,447,261 | 9/1995 | Mitomi et al. . | |

FOREIGN PATENT DOCUMENTS

| | | | |
|---|---|---|---|
| 0 191 885 | 2/1985 | European Pat. Off. . | |
| 2441358 | 7/1980 | France | 224/153 |
| 42 02 135 | 7/1992 | Germany . | |
| 6-217826 | 8/1994 | Japan . | |
| 2 231 846 | 11/1990 | United Kingdom . | |

*Primary Examiner*—Charles R. Eloshway
*Attorney, Agent, or Firm*—Richard C. Litman

[57] ABSTRACT

A portable, variable capacity locker having detachable shoulder straps, wheels, a handle, at least one detachable compartment, and a expandable compartment, of which the intended primary use is for storage of books and schools supplies in lieu of a school locker. The locker defines a storage compartment having a top closure and an expandable lower portion. The expandable lower portion is defined by a flexible expansion sleeve, wherein the mating parts of a zipper, or other suitable closure, are respectively provided at the top and bottom edge of the expansion sleeve. By fastening together the top and bottom edges of the expansion sleeve, a circumferentially zippered wall is formed above the base. Thus, when the zipper is zipped and the sleeve is in a collapsed state, a functional and sturdy pack may be formed for shoulder transport by decreasing the storage compartment volume; when the expansion sleeve is in its expanded state (i.e. the zipper is unzipped), the sleeve is allowed to unfold to vertically enlarge the walls of the pack and increase the volume of the storage compartment. Wheel assemblies are attached to the base thus enabling the user to roll the locker on the surface when the compartments are fully extended and loaded. The locker also includes a detachable pouch with a security tether, and detachable shoulder harness straps which serve an alternative function as a pull strap.

7 Claims, 3 Drawing Sheets

PORTABLE VARIABLE CAPACITY BACKPACK

BACKGROUND OF THE INVENTION

Cross-Reference to Related Application

This application is based on provisional patent application Ser. No. 60/014,443, filed Apr. 1, 1996.

1. Field of the Invention

The present invention relates to a variable capacity shoulder pack having wheels, a pull handle, and detachable compartments that supplement portability, of which the intended primary use is for storage of books and schools supplies in lieu of a school locker.

2. Description of the Prior Art

Schools are increasingly removing hall lockers and denying students access to private storage facilities that have been traditionally located on school premises in light of safety and drug-related concerns. Consequently, pupils need portable, adaptable, and multifunctional containers for transporting and accessing their school supplies and materials. Although individual qualities found in bags and luggage of the prior art may be useful, none have the structure and qualities needed to fulfill the primary purpose of a portable school locker and related needs of a student.

For example, U.S. Pat. No. 3,917,038 issued Nov. 4, 1975 to Foge et al. describes a wheeled suitcase unsuitable as a shoulder pack, the shoulder pack being preferred by most students to transport school materials. Likewise, U.S. Pat. No. 4,087,102 issued May 2, 1978 to Sprague and U.S. Pat No. 4,254,850 issued Mar. 10, 1981 to Knowles describe wheeled travel luggage unsuitable for use by a student or child. U.S. Pat. No. 4,588,055 issued May 13, 1986 to Chen describes a device for towing luggage and U.S. Pat. No. 5,114,164 issued May 19, 1992 to Bothwell et al. describes a wheeled carrying case, both also unsuitable for use as a backpack. Furthermore, large suitcases of flexible body construction with wheels and handles are described in the prior art, such as U.S. Pat. No. 5,109,961 issued May 5, 1992 to Bergman and U.S. Pat. No. 5,303,805 issued Apr. 19, 1994 to Hauser; however, these devices are also structurally unsuitable for adaptation as a child's shoulder pack.

Several patents do however describe rucksacks with retractable wheels and handles. U.S. Patent 5,447,261 issued Sep. 5, 1995 to Mitomi et al. describes a rigid bodied backpack with a cloth cover for carrying ski equipment over snowy surfaces. Japanese Pat. No. 6-217826 issued Jan. 28, 1993 describes a hard shelled rucksack with cloth cover with wheels and a handle. Both devices consist of rigid non-flexible structures which are unsuitable for the varying student needs of growing children. Additionally, German Offenlegungsschrift 42 02 135 A 1 published Jan. 27, 1992 to Ewers describes a large mountaineering backpack with a yoke and wheels. This device is unsuitable for day-to-day use in a school or classroom setting.

Additionally, European Publication No. 0 191 885 published Aug. 27, 1986 to Johannes and U. K. Pat. App. GB 2 231 846 A published Nov. 28, 1990 to Hadlum Brothers Ltd. describe collapsible duffle bags on wheels; the disadvantage of such bags is that they become increasingly collapsed as their contents are removed, thus making such flaccid structure inconvenient for use in its collapsed state for use under classroom conditions. Rummaging through a collapsed bag is not conducive to finding small objects, such as pencils, or protecting brown bag lunches from heavier shifting elements, such as books. U.S. Pat. No. 4,756,394 issued Jul. 12, 1988 to Cohen also describes a collapsible compartment which is likewise unusable in the collapsed form.

Finally, U.S. Pat. No. 5,303,805 issued Apr. 19, 1994 to Hauser describes pivotally mounted support arms whereby additional luggage may be stored during wheeled transport. Further, U.S. Pat. No. issued May 2, 1978 to Sprague, describes extendible handles which provides space to accommodate additional luggage. Neither of these two systems is adaptable to permit attachment to a shoulder pack a smaller complementary detachable compartment.

Thus, a shoulder portable, mobile, stand-alone locker solving the aforementioned problems is desired. None of the above inventions and patents, taken either singly or in combination, is seen to describe the instant invention as claimed.

SUMMARY OF THE INVENTION

The present invention relates to a variable capacity shoulder pack, having detachable shoulder straps, wheels, a handle, at least one detachable compartment, and an expandable compartment, of which the intended primary use is for storage of books and schools supplies in lieu of a school locker. In the preferred embodiment, the locker defines a storage compartment having a top closure and an expandable lower portion. The expandable lower portion is defined by a flexible expansion sleeve, wherein the mating parts of a zipper, or other suitable means of closure, are respectively provided at the top and bottom edge of the expansion sleeve. By fastening together the top and bottom edges of the expansion sleeve, a circumferentially zippered wall is formed above the base. Thus, when the zipper is zipped and the sleeve is in a collapsed state, a functional and sturdy pack may be formed for shoulder transport by decreasing the storage compartment volume; when the expansion sleeve is in its expanded state (i.e. the zipper is unzipped), the sleeve is allowed to unfold to vertically enlarge the walls of the pack and increase the volume of the storage compartment.

At least one opening having a closure mechanism for controlled access to the storage compartment is defined in a wall near the top of the storage compartment. The closure mechanism may include any suitable fastener, such as a zipper, snaps, or of the hook and loop type (VELCRO®) attached to the walls which define the opening. The pack may be made of any material having qualities suited to use as a shoulder pack, such as strength, water repellency, and light weight.

Unlike the collapsible containers shown in the prior art, while the sleeve is in a collapsed state, the locker maintains a rigidity of form allowing the user to continue to enjoy its use by including an internal rib structure. The pack also includes a detachable compartment, with a security tether, that can be easily removed from the pack to provide the user a personal pouch or purse suitable for cosmetics, lunches and small, insulated or uninsulated drink containers, or school supplies such a crayons. The detachable pouch is situated for easy access and removal on the front panel of the pack. The security tether, which deters mischievous removal of the pouch by other youngsters, is made preferably from a quick-release, male-female component type latch. The pouch can be made of any durable material suitable for construction of the main body of the pack. Further, ease of removal can be achieved through the use of a fastener such as of the hook and loop type (VELCRO®).

Further, a wheel assembly is attached to the exterior surface of the base to provide rolling support when the user desires not to carry the locker. A pair of detachable straps, or other suitable shoulder harness, is removably attached to the rear wall, enabling the compartment to be carried on the back of a user and allowing a strap to be selectively removed for use as a pull strap for rolling the locker. Reinforcing bars, which are made of a suitable rigid material, such as steel, plastic or the like, provide an internal ribbing for points of attachment to which the detachable strap may be fastened as a pull strap. The ribbing also prevents tearing of the walls of the compartment at such points of attachment.

Accordingly it is a principal object of the invention to provide a backpack which is adapted to provide an expanding body, thus providing the user versatility of use which has heretofore not been available in the prior art.

It is a further object of the invention to provide a pack with easily detachable compartments having a security tether, that allows the user freedom of movement and access while the larger portable locker is stored.

Still another object of the invention is to provide the locker with wheels and a handle which permit the user to roll the pack on a surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

Similar references character denote corresponding features consistently throughout the attached drawings.

DETAILED DESCRIPTION OF THE PREFERRED EMBODIMENT

The present invention relates to a variable capacity shoulder pack having shoulder straps, wheels, a handle, at least one detachable compartment, and an expandable compartment, of which the intended primary use is for storage of books and schools supplies in lieu of a school locker.

Figure 1:
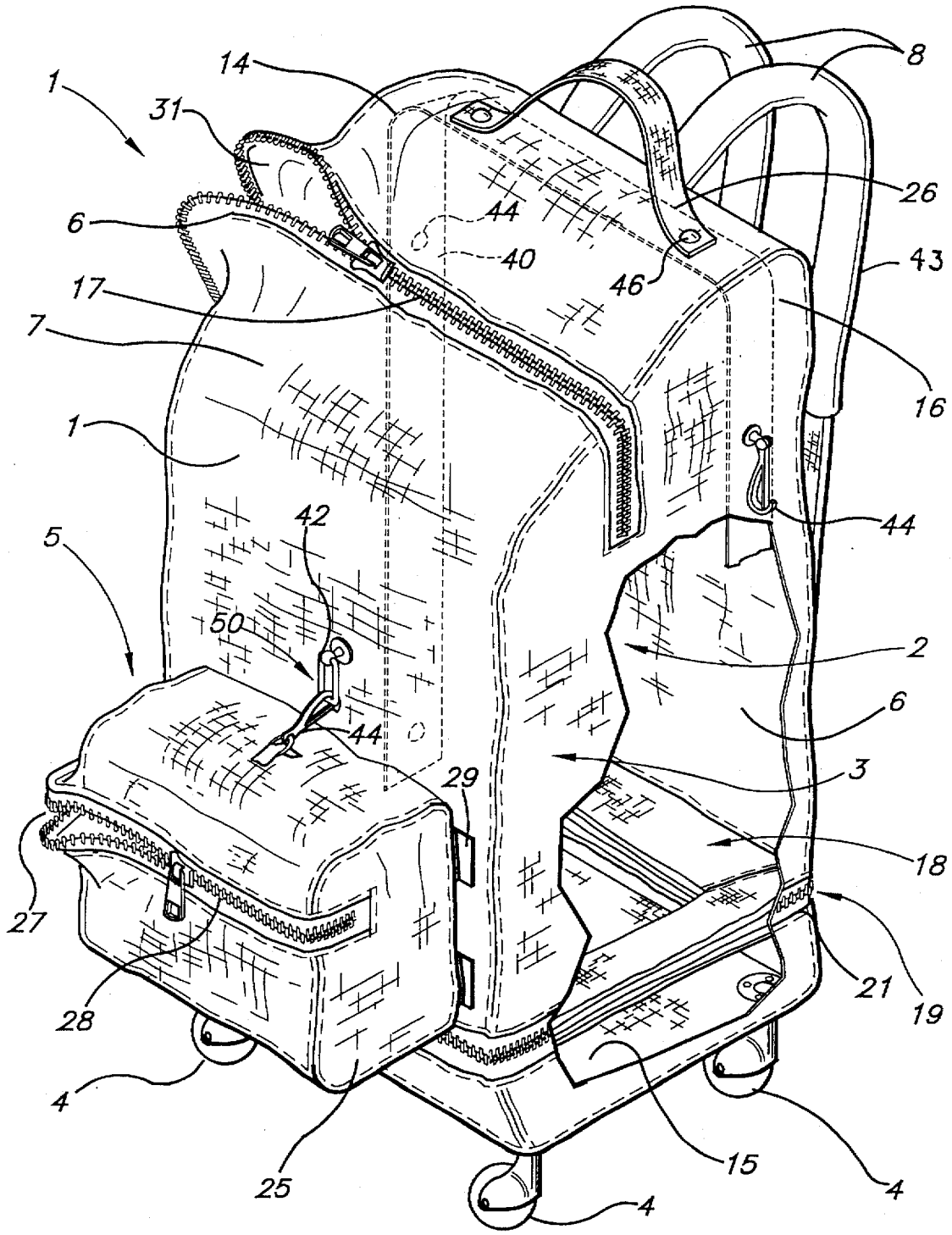
FIG. 1 is a perspective view of the portable locker, a portion being broken away to reveal interior detail.

As shown in FIG. 1, the preferred embodiment of the present invention is the portable locker 1 having several major components comprising the whole. The locker 1 includes at least one storage compartment 2 having a continuous flexible wall 3. The rear wall, although continuous, may be defined as having a rear wall 6, a front wall 7, a top wall 14, side walls 16, and a base 15, thereby defining an enclosed chamber 18. An expansion sleeve 10 is defined as having a fastening means comprising mating parts, (such as zipper 19), which mating parts are spaced apart and attached to the continuous flexible wall 3 in order that each mating part of the zipper 19 may be fastened together to provide unitary and sturdy wall forming chamber 18 and defining the sleeve 10 in a collapsed state. A top opening 31, which may be oriented in any direction so as to conveniently access the chamber 18 of compartment 2, is sealed by zipper 17 attached to the edges 6 of walls 7, 14, and 16 (which also define the top opening 31).

Furthermore, to add rigidity and maintain a substantially upright and supported posture of the locker 1, as well as to act as a reinforcing structure to the wall fabric at various attachment points, a generally U-shaped reinforcement bar 40 is disposed within the chamber 18 and provided on the side walls 16,16 and top wall 14. The reinforcing bar 40 preferably is made of steel and is attached to each side wall 16 with rivets 46. The rivets 46 pass through the side wall 16 and bar 40 at points suitable and necessary to secure the bar to the compartment 2 and to provide reinforcement to stress points. Two such points are shown passing through each end of a handle 26, shown attached to the exterior surface of the top wall 14 for carrying the locker 1 by hand.

A pair of detachable straps 8,8 are also attached to the rear wall 6, enabling the locker to be carried on the back of the user. The straps 8,8 are detachable from the compartment 2 by means of quick-release style latches (such as latches with a male coupling portion 44 and female coupling portion 42), as commonly known in the prior art. A plurality of latches are interposingly attached to each of the straps 8,8 as shown in the preferred embodiment to allow each strap 8 to be completely removed from the compartment 2. Thus, each strap 8 comprises a shoulder harness latch 45 fixedly attached to the compartment 2 having one of two coupling portions, and a strap portion 43 which is terminated at each end by the mating coupling portion.

The base 15 is rigid and substantially defines the cross-sectional area of the chamber 18, which is predetermined in area to be in excess of that area corresponding to the cover of a standard textbook, so that textbooks may be easily stacked or otherwise be placed flat upon the base 15. The base 15 includes a superior edge 21 (best appreciated in FIG. 2) to which the continuous flexible wall 3 is attached. In the alternative, the base 15 may be integral with the wall 3 as manufactured according to methods known in the prior art. The base 15 is made of a material, such as a plastic or metal, which provides adequate structural strength and rigidity to maintain its shape when loaded with objects such as books, and, to provide a rigid attachment for a plurality of wheels 4.

The wheels 4 are attached by any known attachment means to an exterior surface 30 of the base 15 in a manner which allows the locker 1 to stand substantially upright and rollably supported off of a surface by the wheels 4. The wheels 4 provide convenient mobility of the locker 1 when heavily loaded. The strap 8 is used as a convenient extension, or pull strap, by disconnecting the strap portion 43 from the shoulder harness latch 45 and reconnecting the mating latch component 42 to one of a plurality of latch components 44 attached about the storage compartment 2. The plurality of latch components 44 are provided as an attachment point to pull the locker 1 along a surface upon its wheels 4. These points of attachment are preferably provided along the path of the reinforcing bar 40. It should be understood that, although the latch component 44 is shown as a male latch component in the preferred embodiment, either a male or female latch component may be used so long as the latch component used as an attachment point about the storage compartment 2 is structured to be interchangeably mated with the quick release fastener component of the strap end 42 of the strap 8, thereby allowing the strap end 42 to be detached from the storage compartment end 44 and then reattached to the storage compartment attachment points.

Figure 2:
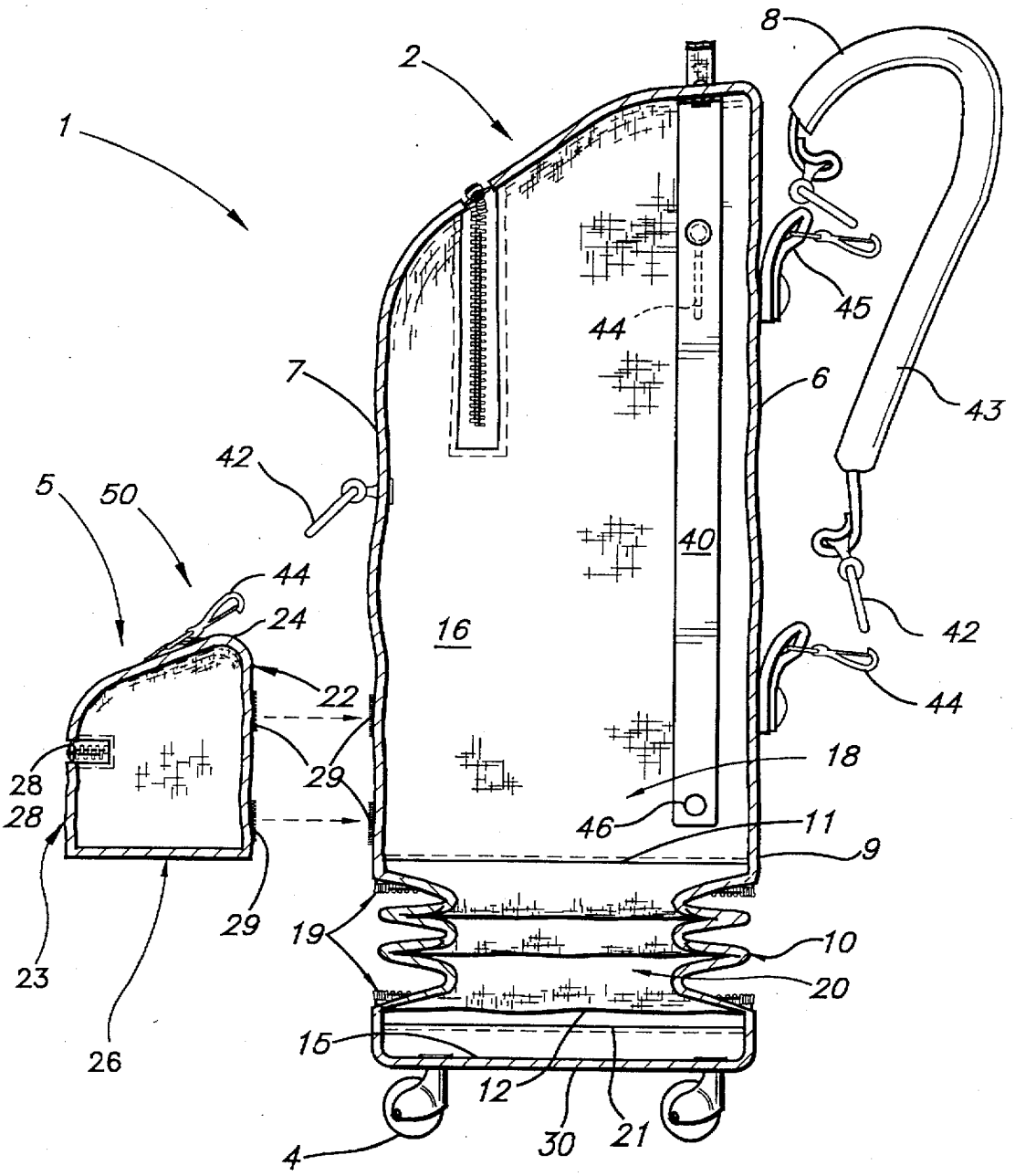
FIG. 2 is a partially exploded, sectional, elevational side view of the portable locker.
Figure 3:
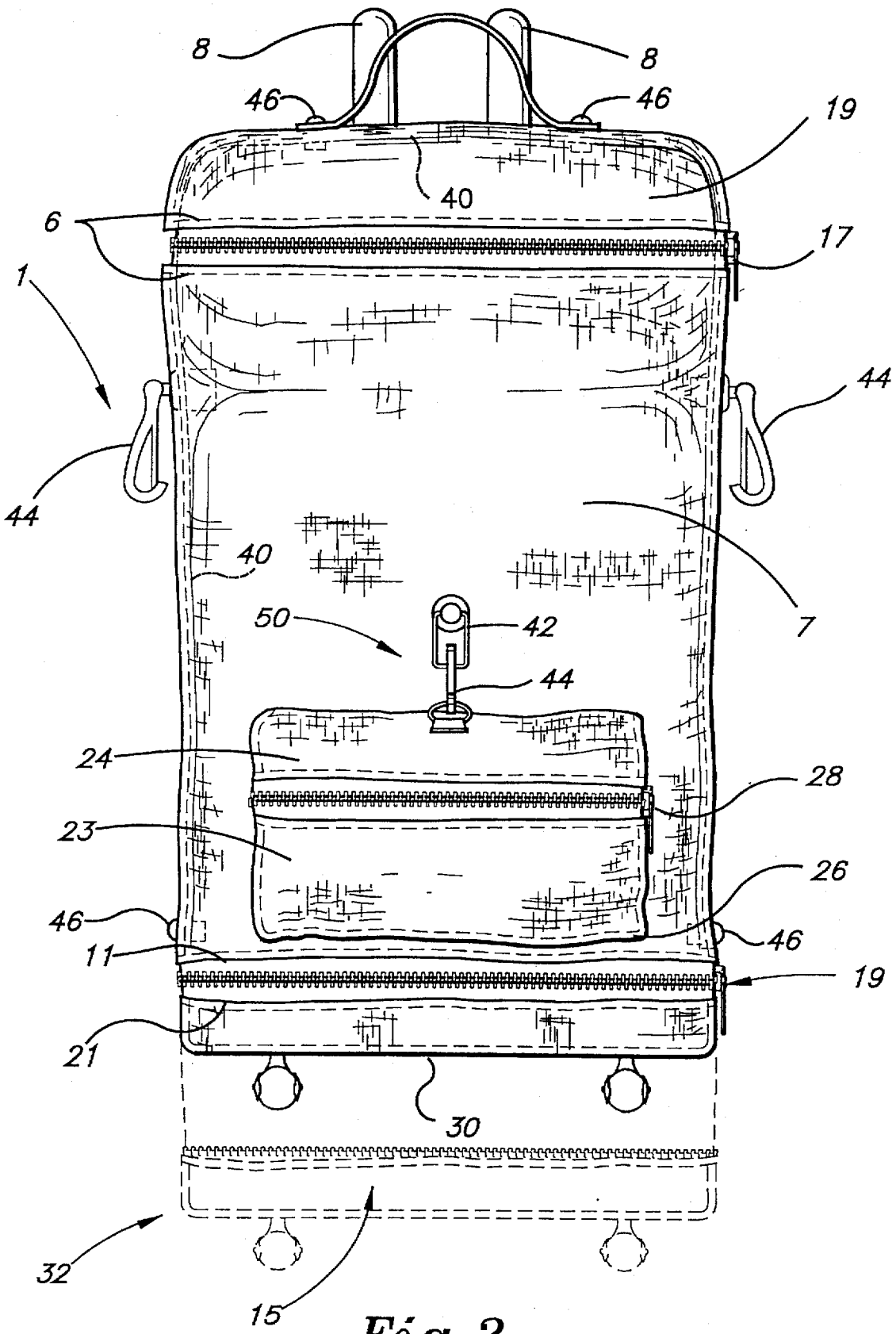
FIG. 3 is an elevational front view of the portable locker.

Referring now to FIG. 2, the expansion sleeve 10 is shown in a partially expanded configuration, in contrast to FIGS. 1 and 3, which show the expansion sleeve 10 in the collapsed and fastened state. The phantom outline 32 in FIG. 3 also depicts the expanded configuration for comparison of the size of the locker between the expanded and collapsed states.

When the locker 1 is in its fully or partially expanded configurations, zipper 19 is unzipped, thereby allowing an annular wall 20 of the expansion sleeve 10 to expand the volume of chamber 18 vertically. The continuous flexible wall 3 of the locker 1 and annular wall 20 may be unitary, and can be made of any suitable material having the characteristics of durability, strength and a flexible rigidity, such as a rubberized plastic, rubberized canvas, vinyl, etc. Alternatively, the annular wall 20 may be made of a separate piece of flexible fabric and joined at the junction of each component of the zipper 19 with the wall 3 or base 15.

Although the preferred embodiment of the expansion sleeve 10 makes use of zipper 19, similar closure means comprising entirely separable mating parts as known in the prior art may be used, such as hooks and eyes, snaps, or hook and loop type fasteners. In the preferred embodiment, one mating part of the second zipper 19 is attached circumferentially and contiguously to the rear wall 6, the front wall 7 and the side walls 16, thereby defining the upper portion 9 of the expansion sleeve 10, and, an annular sleeve 20 extending from a lower edge 11. The other mating part of the second zipper 19 is similarly attached to a lower portion 12 of the annular sleeve 20 and to a superior edge 21 of the rigid base 15. Thus, a wall comprising the annular sleeve 20 is defined as extending continuously between the upper portion 9 and the lower portion 12 of the expansion sleeve 10. Whereas the Figures show the sleeve positioned near the base of the locker 1, alternatively the sleeve 10 may be incorporated into the locker 1 higher relative to its bottom so as to circumferentially bisect it, whereby the lower portion 12 of the expansion sleeve 10 would be attached to a lower portion of the wall 3 instead of directly to the base 15 (not shown).

As shown in FIGS. 1 and 3, the expansion sleeve 10 can be collapsed and the mating parts of the zipper 19 fastened to bring the lower edge 11 of the wall and the superior edge 21 of the base into proximity with each other to create a junction, thereby reducing the volume of the compartment 18. Such a reduced volume configuration is desirable to better accommodate the use of the locker 1 as a backpack during transport on the back of a student.

Finally, FIGS. 1 and 2 show the detachable compartment 5. The detachable compartment 5 includes at least one compartment having a continuous flexible wall defined by a rear wall 22, a front wall 23, a top wall 24, side walls 25, and a flexible base 26. An opening 27 for access to the detachable compartment is defined in a wall near the top, which opening may be variably oriented. The opening 27 is sealable by zipper 28, or other suitable closure means, which is attached to the edges of the walls defining the opening.

In order to secure the detachable compartment 5 to the main storage compartment 2, a hook and loop type fastener 29, such as VELCRO®, or other similar fastening means, is affixed to each the exterior surface of the rear wall of the detachable compartment 22 and the exterior surface of the front wall 7 of the storage compartment 2 in a complementary manner. The complementary strips of hook and loop fastener 29 thereby permit the repeated attachment and removal of the detachable compartment to the storage compartment.

However, in order to deter the mischief in which youngsters may partake when they find that the detachable compartment is easily separated from the storage compartment, a quick release fastener is provided as a tether 50. The fastener comprises a detachable compartment portion (such as male latch component 44) attached to a wall of the detachable compartment 5 and a storage compartment member (such as female latch component 42) preferably attached to the front wall 7 with a rivet. Such quick-release tether 50, if used alone to attach the detachable compartment to the storage compartment, would permit the detachable compartment 5 to dangle, and therefore is not intended as a substitute for the hook and loop type fastening means provided. However, the quick release tether 50 does provide a deterrent effect against the detachable component being intentionally ripped from the front wall 7.

It is to be understood that the present invention is not limited to the sole embodiments within the scope of the following claims.

I claim:

1. A portable, variable capacity backpack comprising:

a resealable storage compartment component, including a rigid base, having an exterior surface and an interior surface;

a first continuous wall defining a top wall, a front wall, a rear wall, and side walls, said first continuous wall further defining at least one access opening having a resealable closure, said first continuous wall including expansion means for expanding the surface area of said first continuous wall, said expansion means comprising an annular sleeve of a foldable material, having an upper portion and a lower portion, the upper portion being contiguously and circumferentially attached to said first continuous wall and the lower portion being contiguously and circumferentially attached to said rigid base in a manner so as to complete an enclosed chamber within said first continuous wall, and fastening means for circumferentially and removably affixing said upper portion of said annular sleeve to said lower portion;

said at least one access opening and said resealable closure disposed in said top wall and extending along and terminating at upper portions of said side walls;

shoulder harness means for enabling said storage compartment component to be carried on the back of a user, said shoulder harness means configured and dimensioned to be worn over each shoulder of a user and being attached to said rear wall, and further having a quick release fastener comprising mating component parts, one component part being attached to said shoulder harness means and a different one component part being attached to said rear wall, thereby defining a detachable shoulder harness means;

a unitary reinforcing bar mounted to said top and side walls within said chamber;

a carrying handle attached to said reinforcement bar by a plurality of rivets passing through each said reinforcing bar, said first continuous wall and said handle;

a plurality of wheel assemblies attached to said exterior surface of said rigid base;

at least one detachable compartment, having a second flexible continuous wall defining a second top wall, a second front wall, a second rear wall, a plurality of second side walls, a second base, and an exterior surface, said continuous wall further defining at least one second access opening having a resealable second closure;

attachment means for removably attaching said detachable compartment to said storage compartment component; and, a quick-release tether, having a first part and a second part complementarily mounted between said storage compartment and said detachable compartment;

whereby said fastening means may be fastened upon bringing said upper portion of said annular sleeve into proximity with said lower portion thereby defining a collapsed state of the expansion means and thereby decreasing the volume of said chamber and whereby further the fastening means may be unfastened to reverse such state thereby increasing the volume of said chamber.

2. The portable, variable capacity backpack according to claim 1, wherein said fastening means is a zipper having entirely separable mating elements.

3. The portable, variable capacity backpack according to claim 1, wherein said continuous wall is made of a flexible fabric material having a characteristic of rigidity of form unless deformed.

4. The portable, variable capacity backpack according to claim 1, wherein said flexible sleeve is integral with said first continuous wall.

5. The portable, variable capacity backpack according to claim 1, wherein said attachment means are complementarily mounted strips of hook and loop type fastener.

6. The portable, variable capacity backpack according to claim 1, wherein said resealable closure is a zipper.

7. The portable, variable capacity backpack according to claim 1, wherein said resealable second closure is a zipper.

* * * * *